US005682612A

United States Patent [19]

Schwarz

[11] Patent Number: 5,682,612

[45] Date of Patent: Nov. 4, 1997

[54] APPLICATOR GLOVE AND METHOD OF USE

[76] Inventor: Paul A. Schwarz, 201 St. Andrews, St. Simon's Island, Ga. 31522

[21] Appl. No.: 659,354

[22] Filed: Jun. 6, 1996

[51] Int. Cl.[6] ..... A41D 19/00

[52] U.S. Cl. ..... 2/161.6; 2/161.8; 2/162; 2/163; 2/168; 47/1.5

[58] Field of Search ..... 2/16, 21, 159, 2/158, 161.6, 161.7, 161.8, 163, 59, 60, 160, 162, 168, 169; 401/7, 6; 47/1.5; 15/227, 229.11, 104.94; 604/292

[56] References Cited

U.S. PATENT DOCUMENTS

| | | | |
|---|---|---|---|
| 203,959 | 5/1878 | Townsend | 2/21 |
| 1,161,719 | 11/1915 | Norton | 2/161.8 |
| 1,534,208 | 4/1925 | Gibson | 2/168 |
| 2,641,767 | 6/1953 | Rosa | 2/168 |
| 2,722,706 | 11/1955 | Chopp | 15/227 |
| 2,821,718 | 2/1958 | Hail et al. | 2/162 |
| 3,643,386 | 2/1972 | Grzyll | 2/161.8 |
| 3,701,604 | 10/1972 | Holroyd | 401/7 |
| 4,716,677 | 1/1988 | Moore | 47/1.5 |
| 4,984,299 | 1/1991 | Halldoradottir | 2/16 |
| 5,020,160 | 6/1991 | Cano | 2/159 |
| 5,169,251 | 12/1992 | Davis | 401/7 |
| 5,419,014 | 5/1995 | Piantedosi . | |

*Primary Examiner*—Amy B. Vanatta
*Attorney, Agent, or Firm*—Alvin S. Blum

[57] ABSTRACT

A modified glove makes it possible to treat selected plants with liquid without contaminating adjacent plants such as in use of herbicides for weed control. Adjacent thumb and finger(s) are absorbent pads which hold the treating liquid. When the plant is grasped between thumb and finger, the liquid is dispensed and coats the plant where touched. A special cuff forms a trough to protectively catch any drips. An abrasive element may be attached to one or more of the fingers of the glove to scarify the plant while stroking with the liquid loaded absorbent pad to enhance absorbtion of the liquid in plants with a liquid resistant surface.

16 Claims, 1 Drawing Sheet

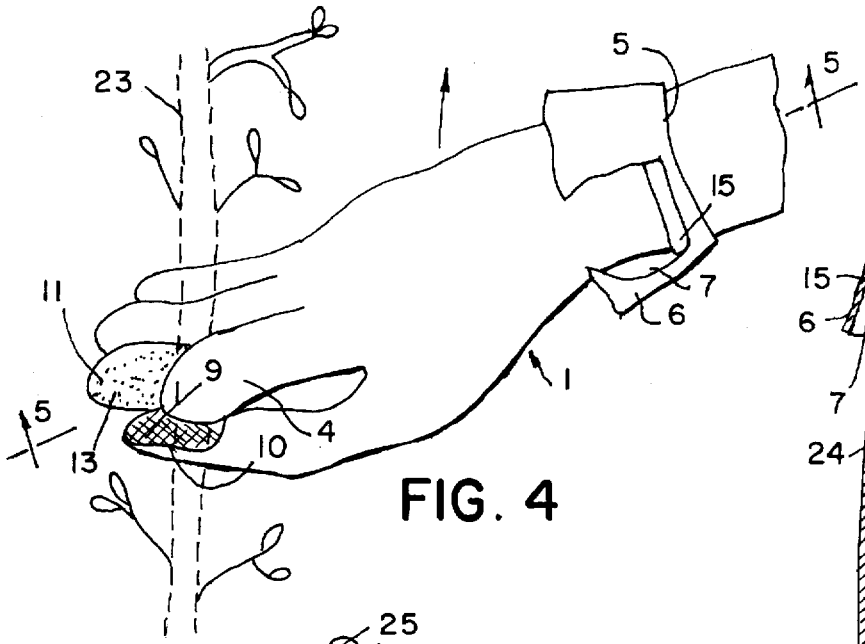
FIG. 4
FIG. 5
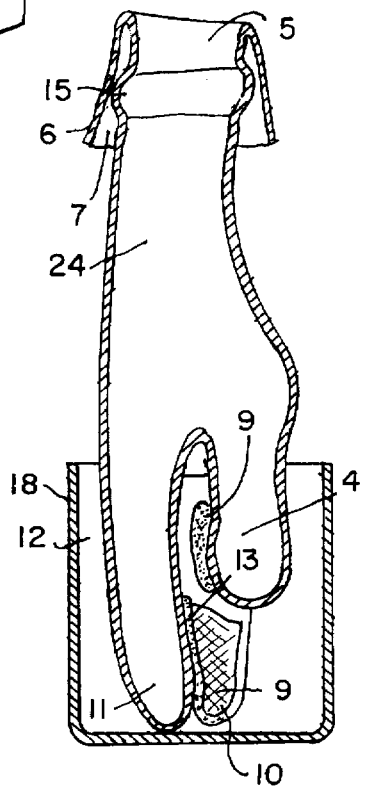
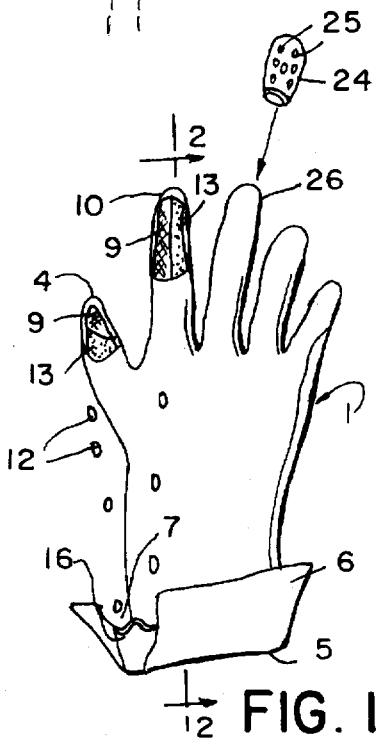
FIG. 1
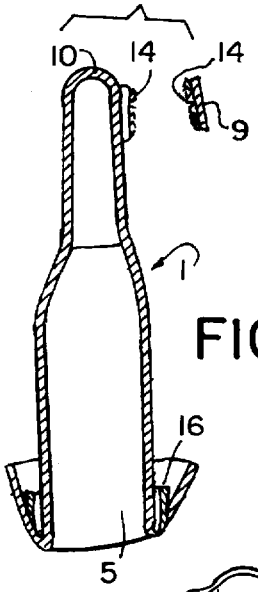
FIG. 2
FIG. 3
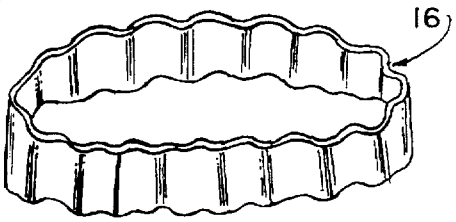
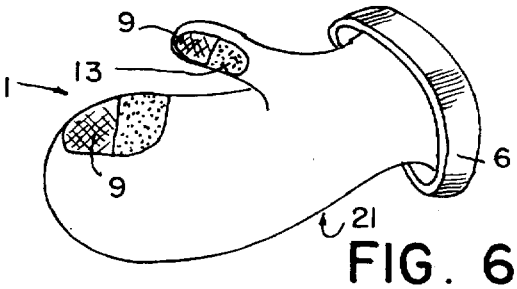
FIG. 6

APPLICATOR GLOVE AND METHOD OF USE

TECHNICAL FIELD

This invention relates to special function gloves, and more particularly to a glove for effectively applying materials to plants while protecting the user.

BACKGROUND OF THE INVENTION

Specialty materials are now available for eradicating plants. These materials are absorbed through the leaves and stems and are carried down to the roots where they kill the entire plant. These materials are very desirable in horticulture because they can kill an undesired plant more easily than trying to uproot it. Many weeds only spread faster when their tops are pulled off. When the weed is growing in a bed of desirable plants, it is helpful if the roots of the good plants do not have to be disturbed by uprooting the weed.

However, the good plants may be as susceptable to the herbicide as the weed. Consequently, the usual method of spraying the herbicide on the weed may not be feasible. This is especially true in a wind. Furthermore, certain weeds may have waxy surfaces that are relatively impermeable to most herbicide preparations. These specialty chemicals may also be quite expensive and somewhat toxic if the spray is inhaled.

SUMMARY OF THE INVENTION

It is, accordingly, an object of the invention to provide a means for selectively applying certain materials such as herbicides to plants that avoids spraying. It is another object that the invention protect the user from contact with the materials to be applied.

It is yet another object that the applicator means enhance the absorbtion of the materials by the selected plants.

The invention comprises a special applicator glove that is impermeable to the material being applied. The glove of the invention is provided with absorbent pads on the thumb and index finger and also alternatively on the middle finger for holding the herbicide and an abrasive pad or areas on the absorbent pads for scarifying the plant to enhance herbicide absorbtion.

The glove is further provided with a trough-like cuff to catch any material which drips down from the pads during the application process.

These and other objects, features and advantages of the invention will become more apparent when the detailed description is studied in conjunction with the drawings in which like reference characters are applied to like elements in the various figures.

BRIEF DESCRIPTION OF THE DRAWINGS

FIG. 1 is a perspective view of a glove of the invention, with a portion of the cuff broken away.

FIG. 2 is a sectional view taken on line 2—2 of FIG. 1.

FIG. 3 is a perspective view of the spacer for the cuff.

FIG. 4 is a perspective view of another embodiment of the invention.

FIG. 5 is a sectional view taken on line 5—5 of FIG. 4.

FIG. 6 is a perspective view of a mitten embodiment of the invention.

DETAILED DESCRIPTION OF THE PREFERRED EMBODIMENTS

Referring now first to FIGS. 1–3, an applicator, glove, or hand covering 1 of the invention is made of a thin flexible material such as latex, vinyl or elastomeric plastic of the type generally referred to as "rubber gloves". The material is selected to be impermeable to the liquid being applied so as to prevent deterioration of the device and to prevent the liquid from contacting the skin and possibly harming the user. To further protect the user when the fingers are held uppermost and the herbicide liquid 12 may drip downward, the opening 5 through which the hand is inserted is provided with an outwardly flaring cuff 6, which forms a trough 7 with the wrist portion of the glove. This trough will catch the drops of liquid and liquid contaminated plant material that might otherwise contaminate the worker. A corrugated sleeve 16 inserted in the cuff holds the trough open.

Absorbent pads 9 are attached to the exterior surface of the glove at the locations 4, 10 adjacent the medial surface of the terminal phalange of thumb and index finger of a hand inserted into the glove. These absorbent pads may take the form of natural or artificial sponges, open cell foams, cellulosic pads and the like as are well known in the art, that are capable of holding volumes of liquid therein. The pads may be attached by cementing with adhesives such as polyurethanes, for example. As shown in FIG. 2, the pad 9 may alternatively be removably attached by removable attaching means such as hook and loop fastener 14. The pads with liquid may then be attached to the glove. The pads may be on resilient thimbles 24 removably attached as at finger 26 of FIG. 1.

When the opposed thumb and fingers of the gloved hand are used to grasp a plant surface such as a leaf or a stem, the absorbent pads will be squeezed against the plant, directly dispensing the liquid onto the plant surfaces to be treated. This is a most economical means of application that is effective in avoiding other plants.

In certain cases the plant may have a surface that is waxy or for some other reason is resistant to penetration of the treating liquid. Abrasive pads or abrasive areas on the absorbent pads may alternatively be provided to operate in conjunction with the absorbtion pads by first scarifying the plant surfaces which are then stroked by the liquid soaked absorbent pads so that the liquid will more easily penetrate the scarified surface. Alternatively, abrasive areas 25 may be attached to the absorbent pads as shown on pad 24 of FIG. 1.

Abrasive elements 13 may be attached adjacent the absorbent pads. These abrasive elements may be any of the abrasive elements well known in industry such as emery cloth or sand paper or the new fibrous abrasive pads. The abrasive elements are so positioned relative to the absorbent pads that a natural grasping and upward pull on the plant will move the abrasive element over a plant surface followed by the absorbent pad in natural are movement.

FIGS. 4 and 5 illustrate another embodiment of the invention in which absorbent pads 9 are on the exterior surface of the glove at the locations 4, 10 adjacent the medial surface of the terminal phalanges of a thumb and index finger of a hand inserted in the glove. The area 11 adjacent the terminal phalange of the middle finger of an inserted hand is provided with the abrasive element 13. As shown in FIG. 5, the gloved hand is inserted in cup 18 filled with the herbicide liquid 12 to load the absorbent pads. Then the gloved hand, as shown in FIG. 4, grasps the plant 23 to be treated and pulls upward. The abrasive element scarifies and then the absorbent pads coat the scarified surface with the treating liquid.

The cuff 6 is kept open to form trough 7 by an alternative mechanism. When the glove 1 is molded, such as by dip coating, it is molded with an annular ring 15 which holds the folded over cuff 6 outward at the opening 5 to the glove body 24.

The hand covering 1 of the invention may alternatively take the shape of a mitten 21, as shown in FIG. 6. The applicator and method may by employed for the selective application of liquids other than herbicides, such as, for example systemic insecticides, and solutions of genetically engineered microorganisms for introduction of special properties into the plant.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. An applicator for selective hand application of liquids to plant surfaces, the applicator comprising:

a protective hand covering body having an exterior surface, and an interior space for receiving a human wrist and hand, the hand having fingers and a thumb, the body having an opening for receiving the hand and a length sufficient to cover and extend from the fingers to the wrist of the hand received therein;

an inverted cuff on the opening facing away from the opening and forming a trough with the body to catch therein liquid when the fingers are held uppermost;

means for holding the trough open;

absorbent pads attached to the exterior surface adjacent the medial surfaces of the terminal phalanges of the thumb and at least one finger of the inserted hand, the absorbent pads adapted for holding a supply of a horticulturally effective liquid and for dispensing therefrom by touching plants selected for treatment with the liquid;

the protective hand covering being composed of a flexible material impervious to the liquid.

2. The applicator according to claim 1, further comprising an abrasive element attached to the exterior surface adjacent the medial surface of the terminal phalange of at least one finger of the inserted hand.

3. The applicator according to claim 1, in which the absorbent pads are removably attached to the exterior surface.

4. The applicator according to claim 3, in which the absorbent pads are attached by hook and loop fasteners.

5. The applicator according to claim 1, further comprising an abrasive element mounted adjacent each absorbent pad on the exterior surface.

6. The applicator according to claim 1, in which the liquid is an herbicide.

7. The applicator according to claim 1, in which the means for holding the trough open comprise a molded annular ring portion.

8. The applicator according to claim 1, in which the means for holding the trough open comprise a corrugated sleeve.

9. The applicator according to claim 1 further comprising a plurality of abrasive areas on the surface of the absorbent pads.

10. A method for selectively applying liquid to plant surfaces, the method comprising the steps of:

A) covering a hand with a glove having an exterior surface that is impervious to the liquid and having an inverted cuff forming a trough to catch therein liquid when the glove is held with the fingers uppermost, the glove provided with liquid absorbent pads attached to the exterior surface adjacent the medial surfaces of the terminal phalanges of the thumb and at least one finger of the covered hand;

B) applying liquid to the absorbent pads;

C) grasping a plant between opposed thumb and at least one finger pad and thereby dispensing liquid from the pad onto the plant so grasped.

11. The method according to claim 10, in which the glove is provided with an abrasive element attached to the exterior surface adjacent the medial surface of the terminal phalange of the middle finger of the covered hand, and the plant is grasped between opposed thumb and at least one finger and further comprising the step of pulling the grasping hand along the plant so that the abrasive element scarifies the plant surface before the absorbent pads reach the scarified surface to enhance absorbtion of the liquid by the plant.

12. The method according to claim 11, in which the glove has an abrasive element adjacent each absorbent pad and further comprising the step of pulling the grasping hand along the plant so that the abrasive elements scarify the plant before the absorbent pads reach the scarified surface to enhance absorbtion of the liquid.

13. The method according to claim 10, in which the liquid comprises an herbicide.

14. The method according to claim 11, in which the liquid comprises an herbicide.

15. The method according to claim 12, in which the liquid comprises an herbicide.

16. The method according to claim 10 further comprising the step of providing abrasive areas on the surface of the absorbent pads for scarifying the plant surface.

* * * * *